US010454218B2

(12) United States Patent
Hsu et al.

(10) Patent No.: US 10,454,218 B2
(45) Date of Patent: Oct. 22, 2019

(54) ELECTRICAL CONNECTOR AND METHOD MAKING THE SAME

(71) Applicant: FOXCONN INTERCONNECT TECHNOLOGY LIMITED, Grand Cayman (KY)

(72) Inventors: Shuo-Hsiu Hsu, New Taipei (TW); Tzu-Yao Hwang, New Taipei (TW); Ming-Lun Szu, New Taipei (TW)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 16/103,892

(22) Filed: Aug. 14, 2018

(65) Prior Publication Data

US 2019/0052021 A1 Feb. 14, 2019

(30) Foreign Application Priority Data

Aug. 14, 2017 (CN) ..... 2017 1 0692626

(51) Int. Cl.

| | |
|---|---|
| ***H01R 12/00*** | (2006.01) |
| ***H01R 13/6471*** | (2011.01) |
| ***H01R 43/20*** | (2006.01) |
| ***H01R 13/24*** | (2006.01) |
| ***H01R 13/422*** | (2006.01) |
| ***H01R 13/428*** | (2006.01) |
| *H01R 12/70* | (2011.01) |

(52) U.S. Cl.

CPC ..... *H01R 13/6471* (2013.01); *H01R 13/2442* (2013.01); *H01R 13/422* (2013.01); *H01R 13/428* (2013.01); *H01R 43/20* (2013.01); *H01R 12/707* (2013.01)

(58) Field of Classification Search

CPC ..... H01R 13/6585; H01R 13/6588; H01R 13/6471

USPC ..... 66/66, 607.1

See application file for complete search history.

(56) References Cited

U.S. PATENT DOCUMENTS 5,527,189 A * 6/1996 Middlehurst ..... H05K 7/1084 439/607.14

5,899,755 A * 5/1999 Kline ..... G01R 1/0466 439/66

(Continued)

FOREIGN PATENT DOCUMENTS

CN 103378492 B 10/2013

CN 103579826 B 2/2014

*Primary Examiner* — Neil Abrams

(74) *Attorney, Agent, or Firm* — Wei Te Chung; Ming Chieh Chang

(57) ABSTRACT

An electrical connector includes an insulative housing and a plurality of signal and ground contacts retained in the housing. The housing forms opposite mating surface and mounting surface, and a plurality of signal contact passageways and ground contact passageways extending therethrough to receive the signal contacts and ground contacts therein. All the mating surface, the mounting surface and the set of interior surfaces of each signal contact passageway and each ground contact passageway are plated/coated with corresponding metal layers while some dividing structures are formed on the mating surface and the mounting surface so as to electrically separate the metal layers of the signal contact passageways from those of the ground contact passageways.

20 Claims, 7 Drawing Sheets

(56) References Cited

U.S. PATENT DOCUMENTS 6,641,411 B1 * 11/2003 Stoddard ..... H01L 23/49838 257/E23.07
6,811,410 B2 * 11/2004 Figueroa ..... H01R 13/6625 439/264
6,877,998 B1 * 4/2005 Kim ..... H05K 7/1092 439/108
6,890,213 B2 * 5/2005 Ohtsuki ..... H01R 13/6599 439/607.35
7,114,959 B2 * 10/2006 Stone ..... H01R 13/2442 439/66
7,329,150 B2 * 2/2008 Ju ..... H01R 12/716 439/607.11
7,442,083 B1 * 10/2008 Ju ..... H01R 13/6599 439/607.05
7,845,955 B2 * 12/2010 Nakayama ..... G01R 1/07371 439/66
8,167,652 B1 * 5/2012 Ju ..... H01R 12/714 29/592.1
8,277,256 B2 * 10/2012 Ju ..... H01R 13/6599 439/626
8,491,337 B2 * 7/2013 Cai ..... H01R 12/57 439/607.28
8,647,153 B2 * 2/2014 Ju ..... H01R 12/714 439/626
8,727,808 B2 * 5/2014 Mason ..... H01R 13/6585 439/607.05
8,821,192 B2 * 9/2014 Chang ..... H01R 13/646 439/630
8,851,904 B2 * 10/2014 Chang ..... H01R 12/71 439/607.03
9,033,737 B2 * 5/2015 Chang ..... H01R 13/6588 439/607.05
9,039,448 B2 * 5/2015 Mason ..... H01R 12/714 439/607.09
9,048,591 B2 * 6/2015 Chang ..... H01R 13/6597
9,059,545 B2 * 6/2015 Mason ..... H01R 12/714
9,065,216 B2 * 6/2015 Chang ..... H01R 13/6585
9,240,657 B2 * 1/2016 Chang ..... H01R 13/6588
9,263,841 B2 * 2/2016 Hwang ..... H01R 43/24
9,325,118 B2 * 4/2016 Chang ..... H01R 13/6466
9,474,147 B2 * 10/2016 Masuda ..... H05K 1/0216
9,491,881 B2 * 11/2016 Heppner ..... H05K 7/1069
10,236,635 B2 * 3/2019 Ju ..... H01R 13/6597
2018/0261938 A1 * 9/2018 Petit ..... H01R 13/41
2018/0366881 A1 * 12/2018 Chang ..... H01R 13/6588
2019/0052021 A1 * 2/2019 Hsu ..... H01R 13/6471

* cited by examiner

ELECTRICAL CONNECTOR AND METHOD MAKING THE SAME

BACKGROUND OF THE INVENTION

1. Field of the Invention

The invention relates to the electrical connector, particularly to the electrical connector with metal layers coated on both the exterior surfaces and interior surfaces for use with the electronic package and the printed circuit board.

2. Description of Related Art

U.S. Pat. No. 8,821,192 discloses the electrical connector with an insulative housing having the exposed outer surface located with grounding metal layer and defining the contact passageway fore receiving the ground contact with the interior surface coated with metal layer connected with the metal layer on the outer surface while understandably the remaining contact passageways for receiving the signal contacts remain uncoated for being isolated from the metal layer. Actually, during manufacturing it is required to use means for blocking the signal contact passageways when plating the interior surfaces of the corresponding ground contact passageways, and successively such means should be removed from the corresponding signal contact passageways. It is laborious and easy to be contaminated because such means may be the protective coating initially applied upon the interior surface of the signal contact passageway before plating the interior surface of the ground contact passageway, and successively washed out after the plating.

It is desired to have the electrical connector without such shortcomings.

SUMMARY OF THE INVENTION

An electrical connector for connecting the electronic package and the printed circuit board, includes an insulative housing and a plurality of contacts retained in the housing. The contacts include the signal contacts and the ground contacts. The housing forms opposite mating surface and mounting surface, and a plurality of contact passageways including signal contact passageways and ground contact passageways extending therethrough. Each of the contact passageways is formed by a set of corresponding interior surfaces. The signal contact is received in the signal contact passageway and the ground contact is received in the ground contact passageway. All the mating surface, the mounting surface and the set of interior surfaces of each signal contact passageway and each ground contact passageway are plated/coated with corresponding metal layers while some dividing structures are formed on the mating surface and the mounting surface so as to electrically separate the metal layers of the signal contact passageways from those of the ground contact passageways.

Other objects, advantages and novel features of the invention will become more apparent from the following detailed description when taken in conjunction with the accompanying drawings.

DETAILED DESCRIPTION OF THE PREFERRED EMBODIMENT

Figure 1:
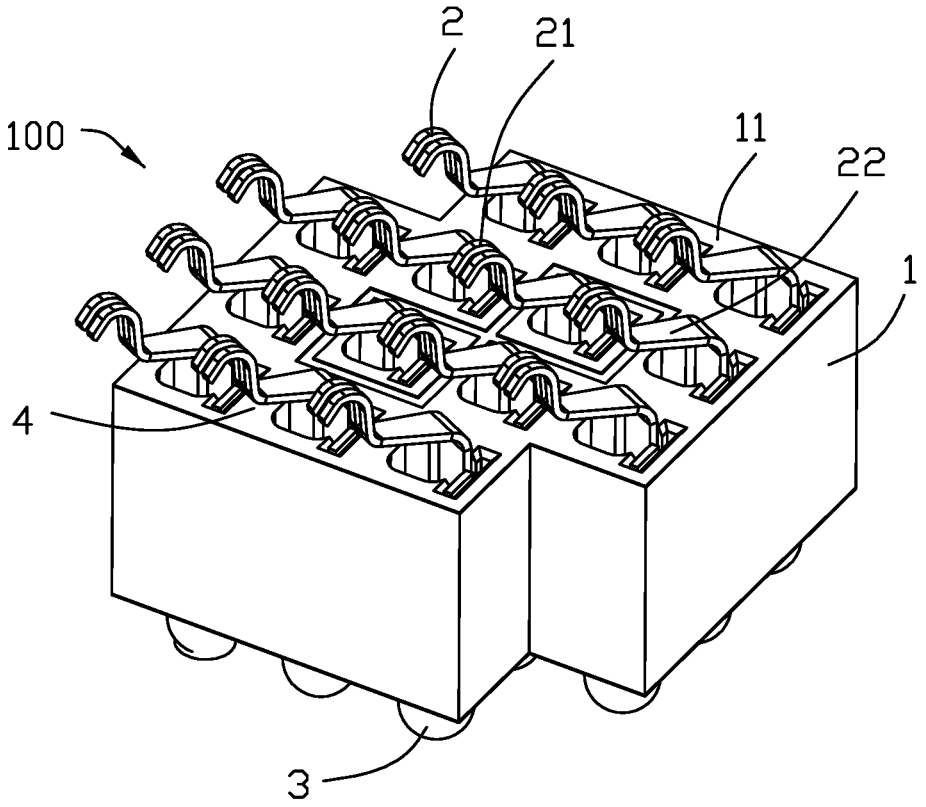
FIG. 1 is a downward perspective view of an electrical connector according to the invention.
Figure 2:
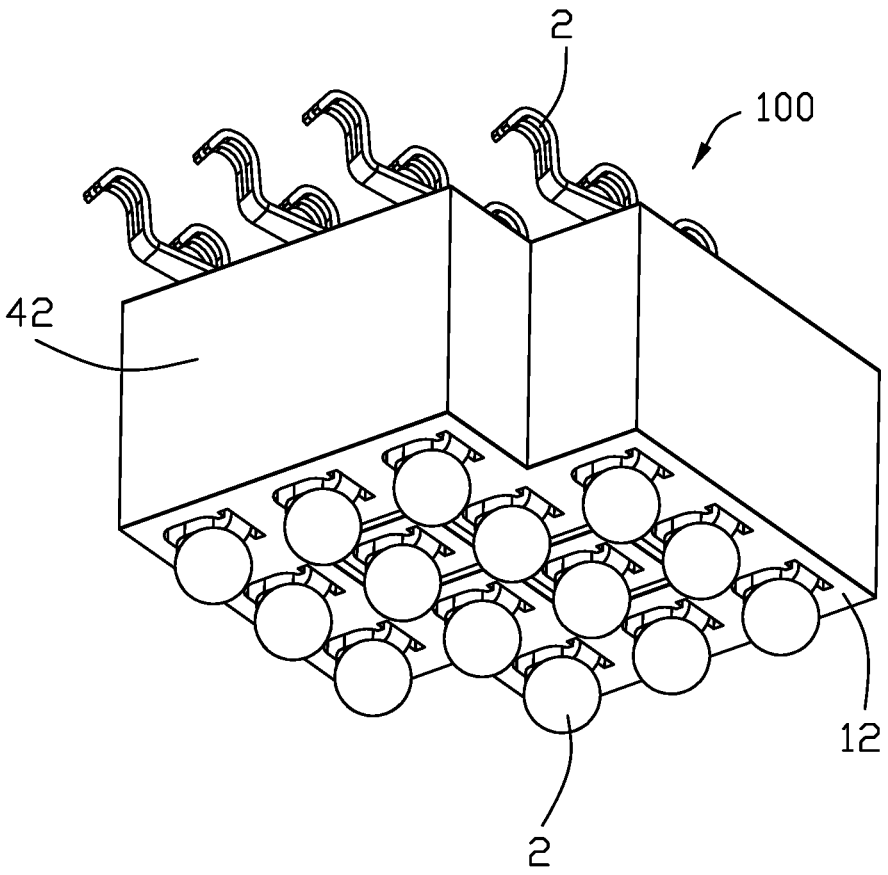
FIG. 2 is an upward perspective view of the electrical connector of FIG. 1.
Figure 3:
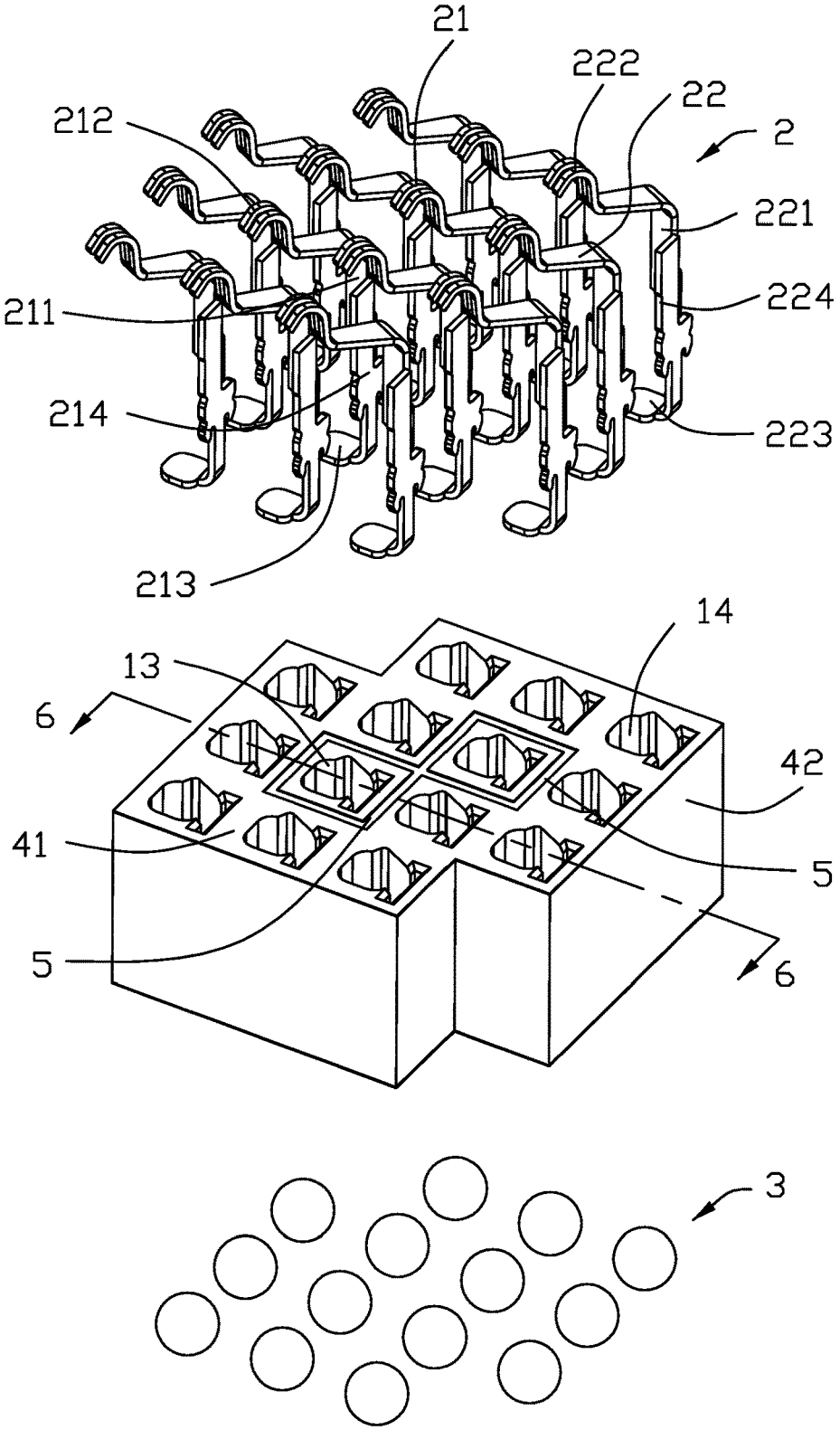
FIG. 3 is a downward exploded perspective view of the electrical connector of FIG. 1.
Figure 4:
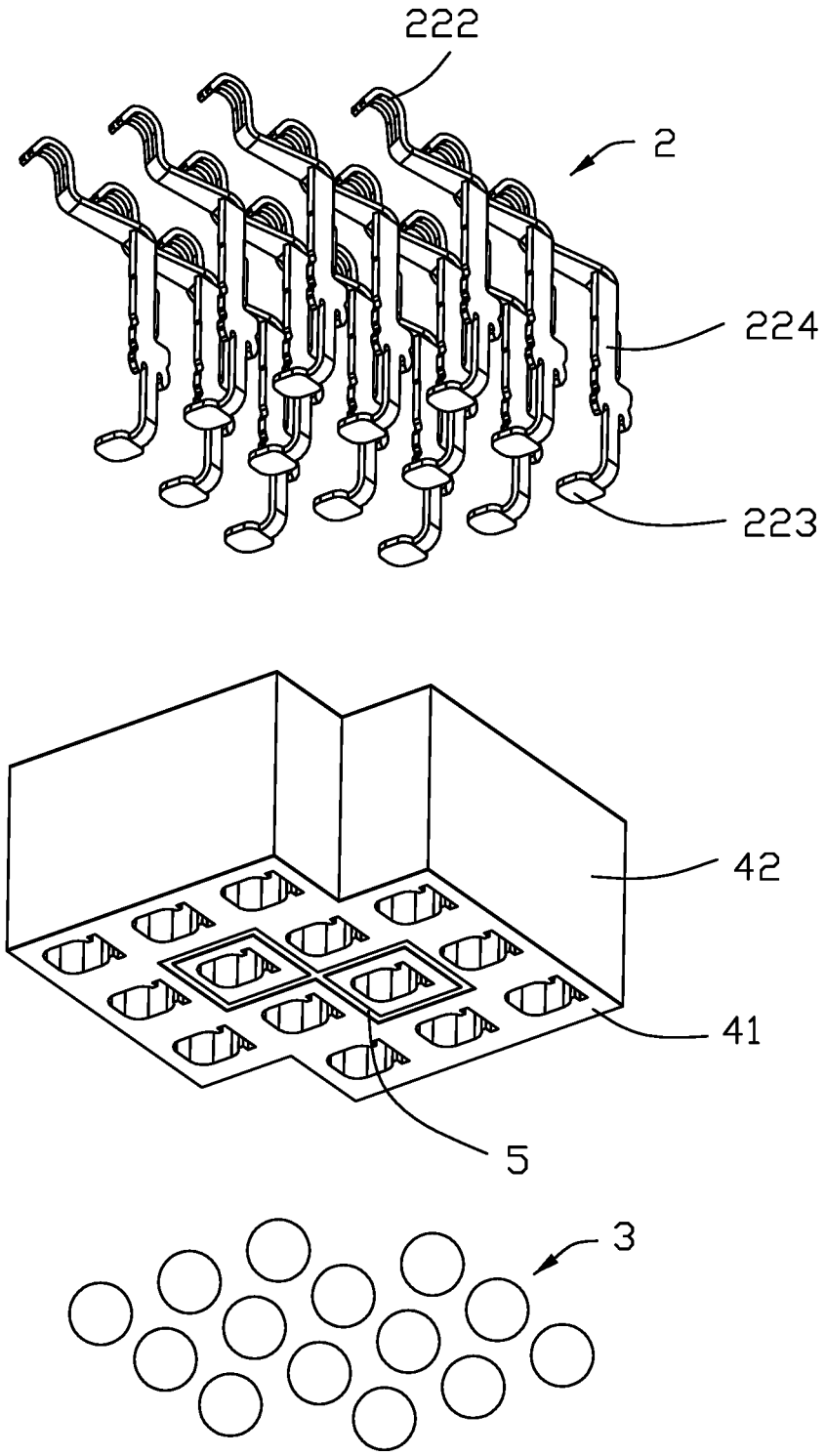
FIG. 4 is an upward exploded perspective view of the electrical connector of FIG. 2.

Referring to FIGS. 1-7, an electrical connector 100 for connecting an electronic package (not shown) to printed circuit board (not shown), includes an insulative housing 1 and a plurality of contacts 2 retained in the housing 1, a plurality of solder ball 3 associated with the corresponding contacts 2 for connecting to the printed circuit board, and a set of metal layers 4 coated on the housing 1.

The housing 2 includes a mating surface 11 for mating with the electronic package, and a mounting surface 12 for mounting to the printed circuit board, opposite to each other in a vertical direction, and a plurality of contact passageways including signal contact passageways 13 and ground contact passageways 14 extend through both the mating surface 11 and the mounting surface 12 in the vertical direction. Each of the contact passageway is circumferentially formed by a set of interior surfaces 15 between the mating surface 11 and the mounting surface 12. The housing 2 further forms set of exterior surfaces 16 between the opposite mating surface 11 and mounting surface 12 and surrounding the contact passageways.

The contacts 2 include the signal contacts 21 and the ground contact 22. The signal contact 21 and the ground contact 22 have the corresponding main bodies 211, 221, the contacting sections 212, 222 extending from the main bodies 211, 221, the retaining sections extending laterally from the main bodies 211, 221, and the soldering sections 213, 223 extending downwardly from the retaining sections 214, 224. The signal contacts 21 are respectively received within the corresponding signal contact passageways 13, and the ground contacts are respectively received within the corresponding ground contact passageways 14. The signal contact passageway 13 and the ground contact passageway 14 have the receiving slots 131, 141 for receiving the main bodies 211, 221 of the signal contact 21 and ground contact 22, and the retaining slots 132, 142 for receiving the retaining sections 214, 224 of the signal contact 21 and ground contact 22.

All the mating surface 11, the mounting surface 12, the set of interior surfaces 15 of each of the signal contact passageways 13 and the ground contact passageways 14, and the set of exterior surfaces 16 are coated/plated with the set of metal layers 4. Both the receiving slots 131, 141 and the retaining slots 132, 142 are located/plated with the metal layers 4. A set of dividing structures are formed on both the mating surface 11 and the mounting surface 12 for isolating signal contact passageway 13 from the ground contact passageway 14, thus assuring no grounding of the signal contact passageway 13. In this embodiment, a set of dividing grooves 5 is formed on each of the mating surface 11 and the mounting surface 12 to electrically isolate the respective signal contact passageways 13 from not only the remaining ground contact passageways 14 but also the other signal contact passageways 13 so as to assure independency of each individual signal contact passageway 13 and the associated signal contact 21. Understandably, in this embodiment the dividing structure is the grooves recessed from the exterior of the housing in the vertical direction. Anyhow, such dividing structure may be a space to divide the metal layers 4 by only removal the previously plated metal layer from the exterior surface of the housing 1 while still keeping the exterior surface in a flush manner. Notably, referring to FIG. 5, the metal layers 4 include the first metal layers 41 applied upon the opposite mating surface 11 and mounting surface 12, and inside the signal contact passageways 13 and ground contact passageways 14, and the second layers 42 upon the exterior surfaces 16 of the housing 1. In this embodiment, the retaining sections 214, 224 of the signal contacts 21 and the ground contacts 22 are electrically and mechanically connected intimately to the retaining slots 132, 142 of the signal contact passageways 13 and the ground contact passageways 14, thus resulting in a reliable and constant electrical connection therebetween. Notably, the metal layers 4 outside of the dividing grooves 5 and the signal contact passageways 13, form a so-called grounding layer which is essentially composed of the metal layers 4 on the mating surface 11, the mounting surface 12, the interior surfaces 15 of the ground contact passageways 14, and the second layer 42 which is applied upon the exterior surfaces 16 of the housing 1.

The method of making the electrical connector 100 comprising the following steps:

(i) providing an insulative housing with opposite mating surface 11 and mounting surface 12 and a plurality of contact passageways including signal contact passageways 13 and ground contact passageways 14 extending through both the mating surface 11 and the mount surface 2, and a set of exterior surfaces 16 between the mating surface and the mounting surface;

(2) sinking the whole housing 1 into a plating fluid to have a set of metal layers 4 coated upon all the mating surface 11, the mounting surface 12, the exterior surface 16 and a set of interior surface 15 of each of the signal contact passageways 13 and the ground contact passageways 14;

(3) forming, on both the mating surface 11 and the mounting surface 12, a set of dividing grooves 5, by etching or laser cutting applied upon the corresponding metal layers 4, to surround the corresponding signal contact passageways 13 viewed in the vertical direction for electrically separating metal layers 4 in the signal contact passageways 13 and those in the ground contact passageways 4, so as to prevent the signal contacts 21 from grounding; and (4) inserting the signal contacts 21 and the ground contact 22 into the corresponding signal contact passageways 13 and ground contact passageways 14, respectively.

Figure 5:
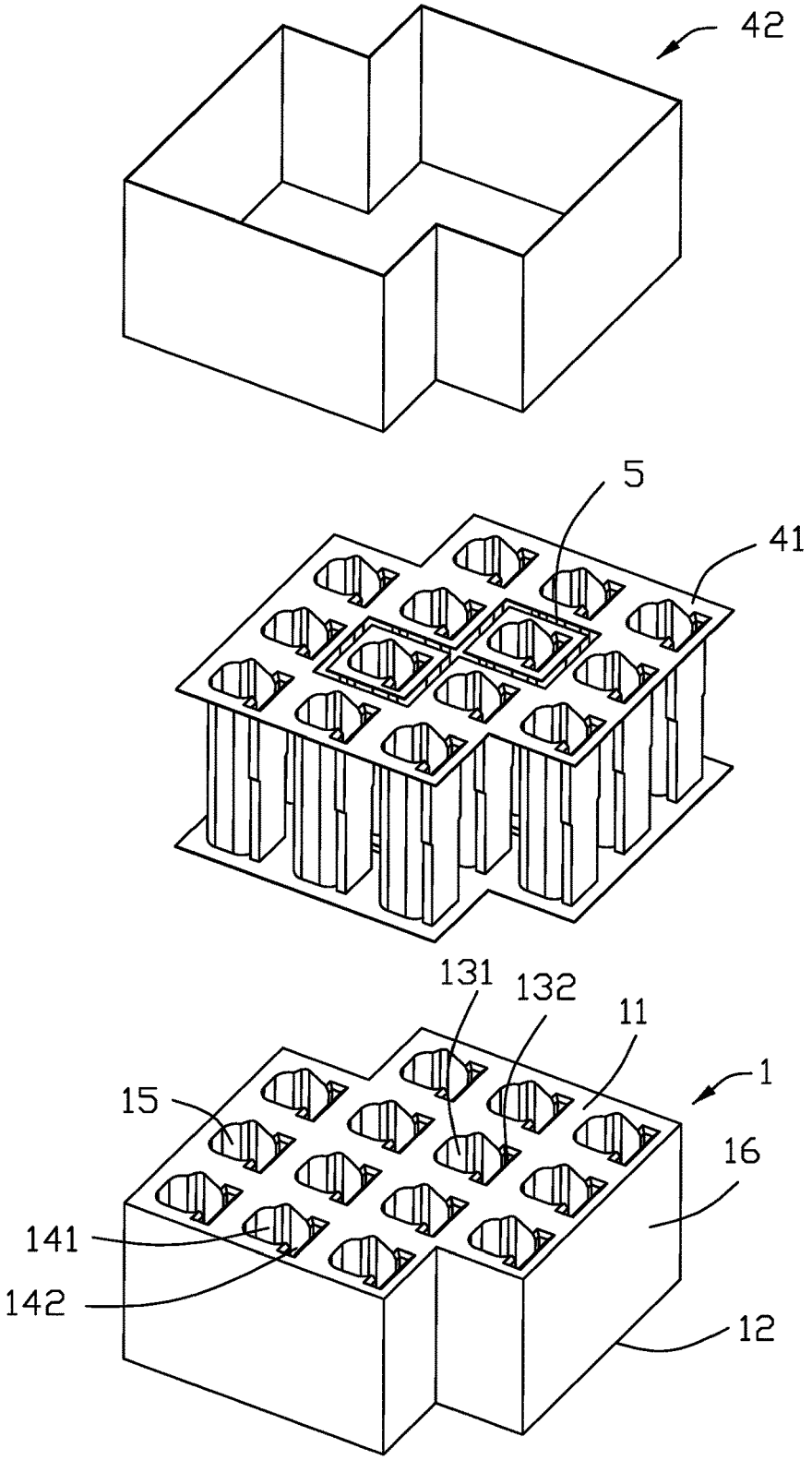
FIG. 5 is a further exploded perspective view of the housing of the electrical connector of FIG. 3.
Figure 6:
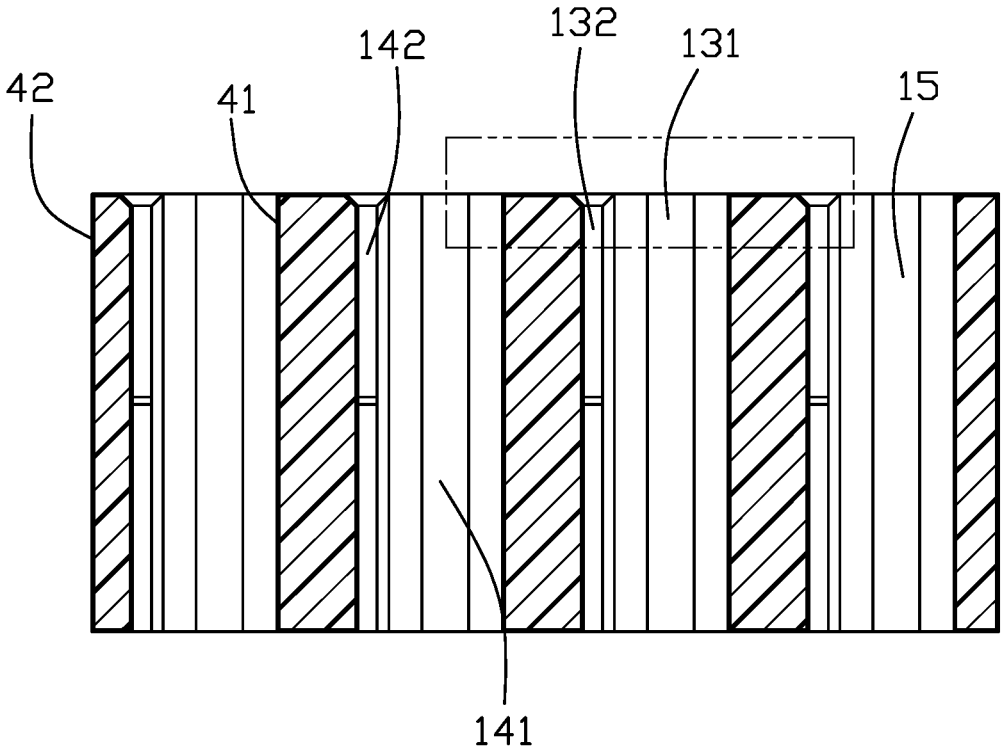
FIG. 6 is a cross-sectional view of the housing of the electrical connector of FIG. 1.
Figure 7:
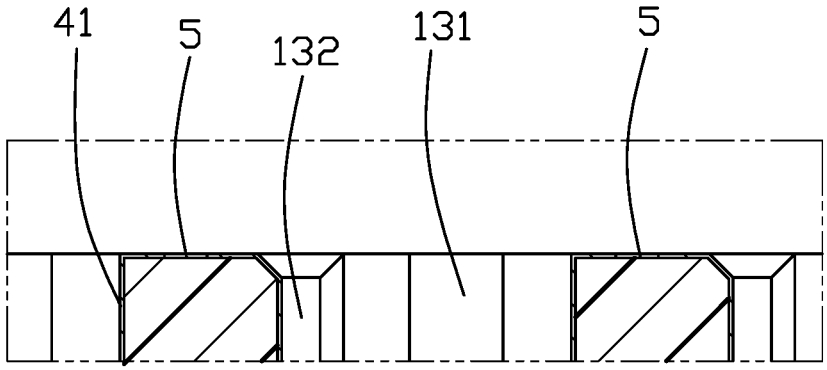
FIG. 7 is an enlarged cross-sectional view of a part of the housing of the electrical connector of FIG. 6.

In brief, in the invention the whole housing 1 can be plated with the metal layers 4 by a single dipping process to form a full continuous in-and-out coating layer structure for superior grounding/shielding effect while the respectively signal contacts may be efficiently isolated from such grounding layer via the set of dividing grooves 5. In additional, the planar engagement between the retaining section 214, 224 and the metal layer 41 may enhance the electrical performance, compared with the point or edge engagement therebetween. As shown in FIG. 5, in the invention each signal contact 21 is mechanically and electrically connected to a corresponding unit composed of first metal layers 41 applied upon the interior surfaces 15, the mating surface 11 and the mounting surface 12 thereabouts, and such a unit is isolated from other units composed of the first metal layers 41 related to other signal contacts 41 and grounding contacts 42. Differently, each ground contact 21 is mechanically and electrically connected to the corresponding unit composed of first metal layers while the unit composed of first metal layers 41 related to the ground contacts 22 are unified together on the mating surface 11 and the mounting surface 12 without dividing. In a technical viewpoint, for each signal contact 21 or ground contact 22, the metal layers 4 coated on the interior surfaces 15 of the corresponding contact passageway always surrounds the main body 211, 221 and the retaining section 214, 224 in an electrical connection manner, thus being different from the conventional design where only the ground contacts are equipped with the connected metal layers.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the members in which the appended claims are expressed.

What is claimed is:

1. An electrical connector comprising:

an insulative housing defining opposite mating surface and mounting surface in a vertical direction;

a plurality of signal contact passageways extending through both the mating surface and the mounting surface in the vertical direction;

a plurality of ground contact passageways extending through both the mating surface and the mounting surface in the vertical direction;

each of said signal contact passageways and said ground contact passageways forming a set of interior surface in a surrounding manner;

a set of metal layers coated upon all the mating surface, the mounting surface and essentially fully the set of interior surfaces of all the signal contact passageways and ground contact passageways;

a plurality of signal contacts disposed in the corresponding signal contact passageways, respectively, a plurality of ground contacts disposed in the corresponding ground contact passageways, respectively; and a set of dividing structures formed on the mating surface and the mounting surface and surrounding the respective signal contact passageways viewed in the vertical direction to electrically isolate the signal contacts from the ground contacts while having the ground contacts electrically connected to a set of grounding layers which is essentially composed of the metal layers applied on the interior surfaces of the ground contact passageways, the mating surface and the mounting surface.

2. The electrical connector as claimed in claim 1, wherein said metal layers are further applied to a set of exterior surfaces of the housing between the mating surface and the mounting surface.

3. The electrical connector as claimed in claim 1, wherein both the signal contacts and the ground contacts constantly mechanically and electrically connect to the corresponding metal layers applied upon the set of interior surfaces of the corresponding signal contact passageways and ground contact passageways.

4. The electrical connector as claimed in claim 1, wherein each of said signal contacts and said ground contacts has a main body, a contacting section, a retaining section and a soldering section, and each of the signal contact package and the ground contact passageway includes a receiving slot to receiving the corresponding main body, and a retaining slot to receive the corresponding retaining section.

5. The electrical connector as claimed in claim 4, wherein both said receiving slot and said retaining slot are coated with the metal layers.

6. The electrical connector as claimed in claim 1, wherein the metal layers applied on the set of interior surfaces of the corresponding signal contact passageway and the metal layers applied upon the mating surface and the mounting surface around the corresponding signal contact passageway, commonly constitute a unit composed of metal layers which is isolated from other units composed of metal layers related to the neighboring signal contact passageways and ground contact passageways for performing independent electrical signal.

7. The electrical connector as claimed in claim 6, wherein the metal layers applied on the set of interior surfaces of the corresponding ground contact passageway and those applied on the mating surface and the mounting surface, commonly constitute a unit composed of metal layers which is unified with metal layers related to the neighboring ground contact passageways so as to form a common grounding layer to which all ground contacts are electrically connected.

8. A method of making an electrical connector, comprising steps of:

providing an insulative housing with opposite mating and mounting surfaces in a vertical direction, and a plurality of signal contact passageways and ground contact passageways extending therethrough in the vertical direction;

each of said contact passageways forming therein a set of interior surfaces circumferentially;

applying a set of metal layers upon essentially fully the set of interior surfaces of each of the contact passageways, and further upon both the mating surface and the mounting surface;

applying a set of dividing structures upon both the mating surface and the mounting surface to separate the metal layers around the corresponding signal contact passageways from those around the corresponding ground contact passageways; and assembling a plurality of signal contacts and a plurality of ground contacts into the corresponding signal contact passageways and the corresponding ground contact passageways, respectively.

9. The method as claimed in claim 8, wherein the signal contact is mechanically and electrically connected to the corresponding metal layers in the corresponding signal contact passageway.

10. The method as claimed in claim 9, wherein the ground contact is mechanically and electrically connected to the corresponding metal layers in the corresponding ground contact passageway.

11. The method as claimed in claim 8, wherein via said dividing structures, the metal layers around respective signal contact passageways are electrically isolated from those around other neighboring signal contact passageways so as to perform independent electrical character thereof.

12. The method as claimed in claim 8, wherein the metal layers around respective ground contact passageways are mechanically and electrically unified with those around the neighboring grounding contact passageways so as to form a single unified grounding layer together.

13. The method as claimed in claim 8, wherein each of said signal contacts and said ground contacts includes a main body, a contacting section and a retaining section, and each of said signal contact passageways and said ground contact passageways is essentially composed of a receiving slot to receiving the corresponding main body freely, and a retaining slot to receiving the corresponding retaining section snugly.

14. The method as claimed in claim 13, wherein the metal layers are applied upon both the receiving slot and the retaining slot so as to form an intimate electrical and mechanical planar engagement between the retaining section and the corresponding metal layer.

15. An electrical connector comprising:

an insulative housing forming opposite mating surface and mounting surface in a vertical direction, a plurality of signal contact passageways and ground contact passageways extending therethrough in the vertical direction;

a plurality of signal contacts retained in the corresponding signal contact passageways, respectively;

a plurality of ground contacts retained in the corresponding ground contact passageways, respectively;

each of said signal contact passageways and said ground contact passageways forming a set of interior surface in a surrounding manner;

a set of metal layers coated upon at least one of the mating surface and the mounting surface, and further upon essentially fully the set of interior surfaces of all the signal contact passageways and ground contact passageways; and each of the signal contact passageways and the ground contact passageways is equipped with a unit composed of the metal layers;

wherein the unit of the signal contact passageway is isolated from other units of the neighboring signal contact passageways and ground contact passageways while that of the ground contact passageway is unified with other units of the neighboring ground contact passageways to form a signal common grounding layer.

16. The electrical connector as claimed in claim 15, wherein each of said signal contacts and said ground contacts forms a main body, a contacting section and a retaining section, and each of said signal contact passageways and said ground contact passageways forms a receiving slot receiving the corresponding main body therein loosely, and a retaining slot receiving the corresponding retaining section therein securely, and both said receiving slot and said retaining slot are coated with the corresponding metal layers.

17. The electrical connector as claimed in claim 15, wherein said metal layers are further coated upon a set of exterior surfaces of the housing surrounding said signal contact passageways and said ground contact passageways and located between the opposite mating surface and mounting surface in the vertical direction.

18. The electrical connector as claimed in claim 15, wherein the metal layers are applied upon both the mating surface and the mounting surface.

19. The electrical connector as claimed in claim 15, wherein each unit includes the metal layers applied upon both the set of interior surfaces of the corresponding signal contact passageway or grounding contact passageway, and further upon said at least one of said mating surface and said mounting surface.

20. The electrical connector as claimed in claim 15, wherein a plurality of dividing structures are formed on said at least one of said mating surface and said mounting surface to isolate the metal layers related to the signal contacts from those related to the ground contacts.

* * * * *